US008578975B2

(12) United States Patent
Ernst

(10) Patent No.: US 8,578,975 B2
(45) Date of Patent: Nov. 12, 2013

(54) OIL FILTER CHANGE METHOD AND APPARATUS

(76) Inventor: Gregory R. Ernst, Eagle Creek, OR (US)

( * ) Notice: Subject to any disclaimer, the term of this patent is extended or adjusted under 35 U.S.C. 154(b) by 795 days.

(21) Appl. No.: 12/263,304

(22) Filed: Oct. 31, 2008

(65) Prior Publication Data

US 2010/0108191 A1 May 6, 2010

(51) Int. Cl.
*B65B 1/04* (2006.01)
*B67D 7/32* (2010.01)

(52) U.S. Cl.
CPC ..... *B67D 7/3209* (2013.01)
USPC ..... 141/86; 141/1; 141/330; 137/312; 137/313

(58) Field of Classification Search
USPC ..... 141/1, 86, 330, 331, 340, 341, 342, 141/343; 137/312–314; 222/460–462; 123/198 BD
See application file for complete search history.

(56) References Cited

U.S. PATENT DOCUMENTS 4,013,105 A * 3/1977 Uuskallio ..... 141/86
4,177,529 A * 12/1979 Sikula, Jr. ..... 7/100
4,776,431 A 10/1988 Poling
4,865,156 A 9/1989 Poling
4,867,017 A * 9/1989 Holman ..... 81/121.1
4,913,813 A * 4/1990 Covarrubias et al. ..... 210/232
5,117,878 A * 6/1992 Shaw et al. ..... 141/333
5,169,541 A * 12/1992 Wells ..... 210/767
5,291,921 A * 3/1994 Devine ..... 141/86
5,301,724 A 4/1994 Maxwell
5,372,219 A * 12/1994 Peralta ..... 184/1.5
5,421,223 A * 6/1995 Wawrzyniak ..... 81/121.1
5,454,960 A * 10/1995 Newsom ..... 210/805
5,480,072 A * 1/1996 Ripley ..... 222/460
5,505,295 A * 4/1996 Whittington ..... 206/223
5,655,624 A * 8/1997 Kelly, Jr. ..... 184/1.5
5,694,990 A * 12/1997 Crima ..... 141/330
5,704,383 A * 1/1998 Kammeraad et al. ..... 137/15.14
5,722,508 A 3/1998 Kraus
5,857,503 A * 1/1999 Vreeken ..... 141/332
5,896,886 A * 4/1999 Wendt ..... 137/318
5,921,292 A 7/1999 Fouts
6,652,664 B2 * 11/2003 Durocher et al. ..... 134/26
6,938,639 B1 * 9/2005 Robinson ..... 137/312
6,941,703 B2 * 9/2005 MacLean et al. ..... 52/34
6,988,640 B2 * 1/2006 Backe ..... 222/109
7,036,536 B1 * 5/2006 Knight et al. ..... 141/86
7,077,177 B2 * 7/2006 Awad ..... 141/330
7,156,067 B1 * 1/2007 Gottschalk ..... 123/198 DB

* cited by examiner

*Primary Examiner* — Timothy L Maust
(74) *Attorney, Agent, or Firm* — patenttm.us

(57) ABSTRACT

An oil filter change method and apparatus for use with Harley Davidson motorcycles employs a filter funnel adapted to fit beneath the oil filter prior to removal. A drain hose may be attached to a spout portion of the funnel, the filter is punctured, and oil allowed to drain therefrom. Once drained, the filter is fully removed, and is held in the funnel for removal, with minimal or no oil spillage onto the engine of the motorcycle.

26 Claims, 16 Drawing Sheets

OIL FILTER CHANGE METHOD AND APPARATUS

BACKGROUND OF THE INVENTION

This invention relates to motorcycles, and more particularly to oil filter change apparatus and methods for use with motorcycles having oil filters mounted in horizontal or otherwise angled orientation whereby oil spills are likely when changing the filter, such as, for example, Harley Davidson brand motorcycles.

Due to the configuration and placement of the oil filter on certain models of motorcycles, Harley Davidson brand motorcycles being a specific example, during oil change operations, removal of the old filter results in oil dripping onto the engine, frame or body of the motorcycle, which then requires cleanup. The oil filter is mounted at the front of the engine, positioned in a horizontal alignment, rather than vertical, such that when the filter is removed, the oil supply and return openings of the motorcycle will drip oil onto the engine or other portions of the motorcycle until a new filter is attached and tightened sufficiently to re-seal those openings.

SUMMARY OF THE INVENTION

In accordance with the invention, a method and apparatus for changing oil filters employs a flexible funnel member shaped to fit underneath the oil filter on motorcycles with a horizontal or other angle oil filter mounting configuration, such as certain Harley Davidson brand motorcycles, to allow the oil to be drained from the oil filter as the filter is removed without the oil dripping onto the engine when the oil filter seal to engine is broken as the filter is removed. Optionally, a drain tube may be attached to the funnel member to direct the draining oil into a desired capture vessel.

Accordingly, it is an object of the present invention to provide an improved method and apparatus for changing oil filters.

It is a further object of the present invention to provide an improved oil filter change apparatus and method for motorcycles to avoid oil undesirably spilling from the filter while changing.

It is yet another object of the present invention to provide an improved oil filter change apparatus and method for motorcycles with oil filters mounted in configurations that tend to result in unavoidable oil spillage when changing.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

The system according to a preferred embodiment of the present invention comprises a funnel apparatus configured to fit beneath an oil filter of a motorcycle wherein the oil filter is laterally mounted or otherwise mounted at such an angle that the likelihood is high of spilling oil when changing the oil filter, whereby the filter can be punctured and the oil allowed to drain therefrom before removal of the filter from the motorcycle. The funnel apparatus captures the filter after it is removed, for easy removal.

Figure 1:
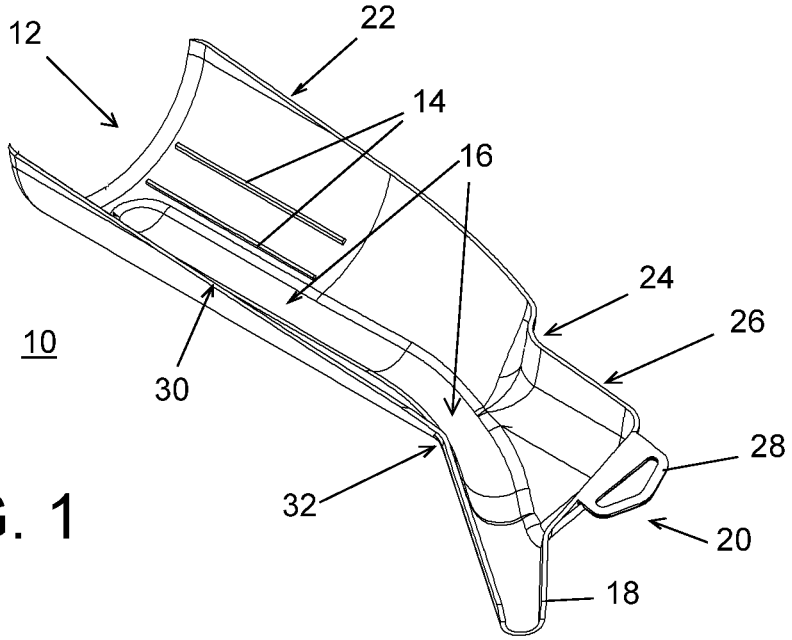
FIG. 1 is a perspective view of an oil filter change funnel apparatus in accordance with the invention.

Referring to FIG. 1, a perspective view of a particular embodiment of an oil filter change funnel apparatus in accordance with the invention, the funnel 10 comprises an elongate generally hemispherical filter receiving end 12 that defines an opening of sectional shape that generally corresponds to the shape of an oil filter. Plural longitudinal ribs 14 are placed on the inner face of the funnel near the filter receiving end, and a drain channel 16, comprising a depression in the inner face of the funnel along a longitudinal portion thereof, is defined at the bottom face of the funnel, beginning slightly inwardly of the end 12 and extending the length of the funnel to meet with a spout portion 18 defined at the end 20 opposite of end 12. Beginning at a position just beyond the inner ends of ribs 14, one side 22 of the funnel 10 is tapered in a curved manner, being widest at the position near the inner ends of the ribs 14, and narrowest at a position closer to end 20 wherein an inward step portion 24 is defined, with side 26 of funnel being substantially straight as compared to the curved taper portion. A hang tab member 28 may be removably provided at the end of the funnel. A score line can be formed such that the hang tab member 28 can be separated from the funnel, if the user does not wish to have the tab remain on the funnel. Side 30 of the funnel, opposite side 22, is substantially straight up to point 32, wherein the funnel bends to define spout portion 18.

Figure 2:
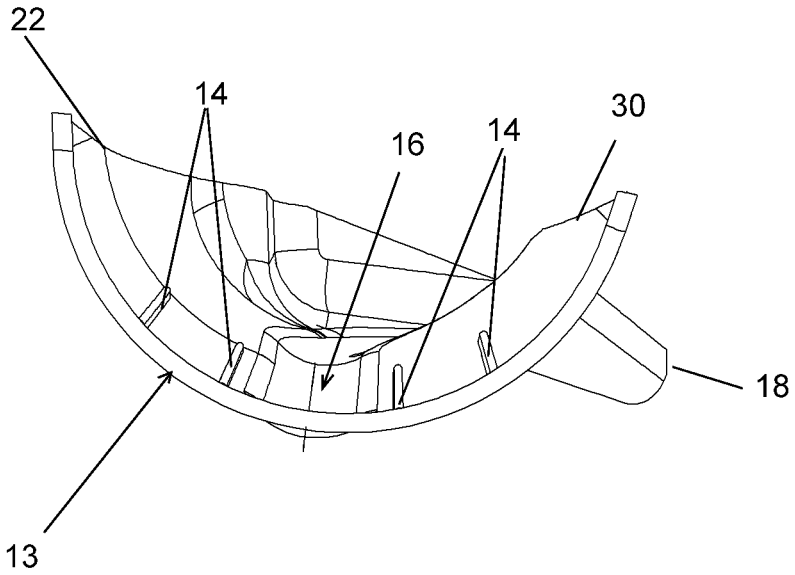
FIG. 2 is an end view of the oil filter of FIG. 1.

Referring to FIG. 2, an end view of the funnel 10, the peripheral edge 13 of end 12 defines a substantially hemispherical region providing flat face edge adapted for placement against the oil filter seal surface of a motorcycle, for providing a temporary seal when placed against the seal surface, to enable oil draining from the filter and motorcycle via the filter mounting, to be directed for controlled drainage away from the engine.

The funnel 10 is suitably made by injection molding plastic to provide some flexibility but sufficient rigidity to generally maintain the shape of the funnel during use.

Figure 3:
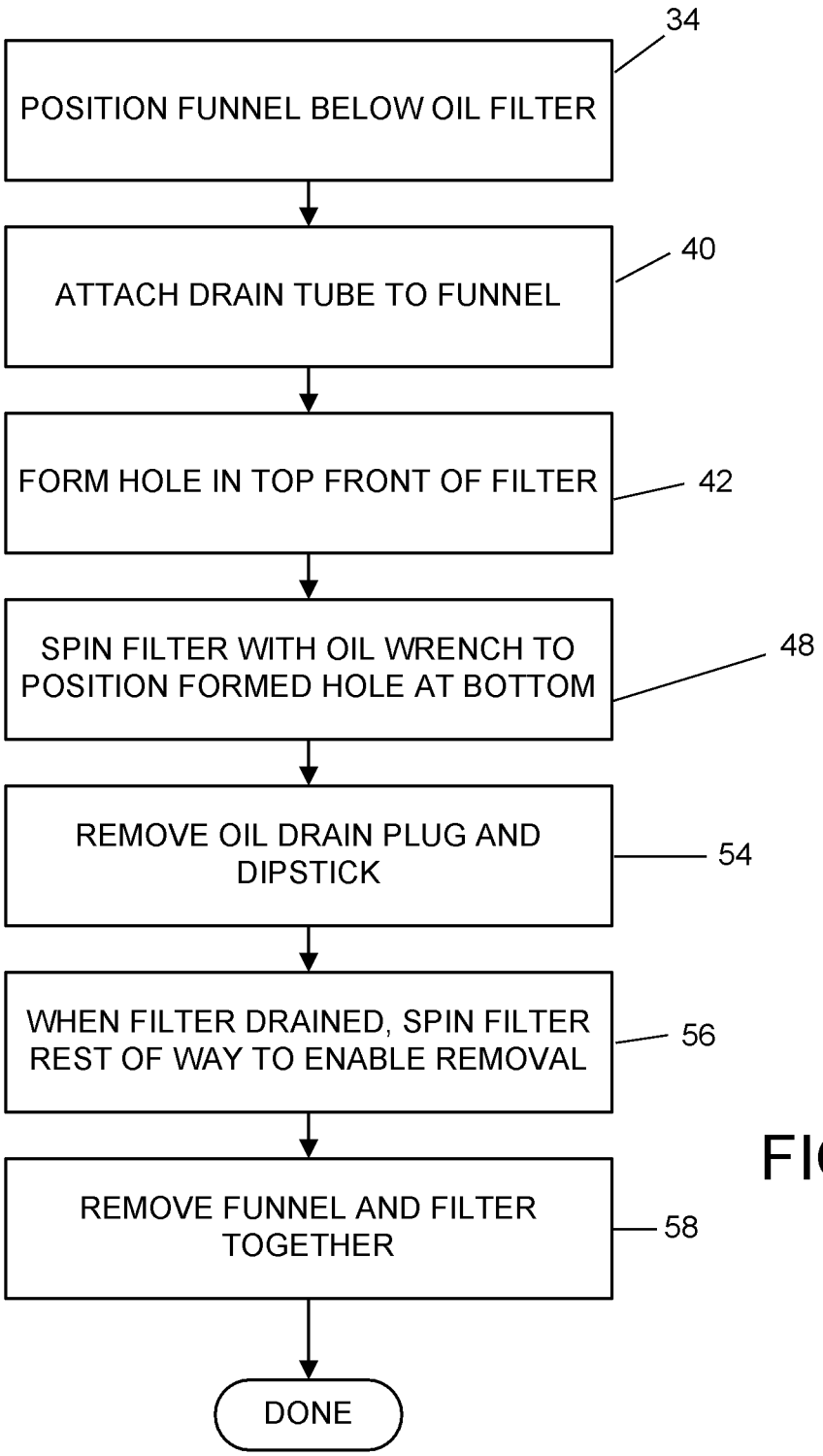
FIG. 3 is a flowchart of the method steps in accordance with the invention.
Figure 4:
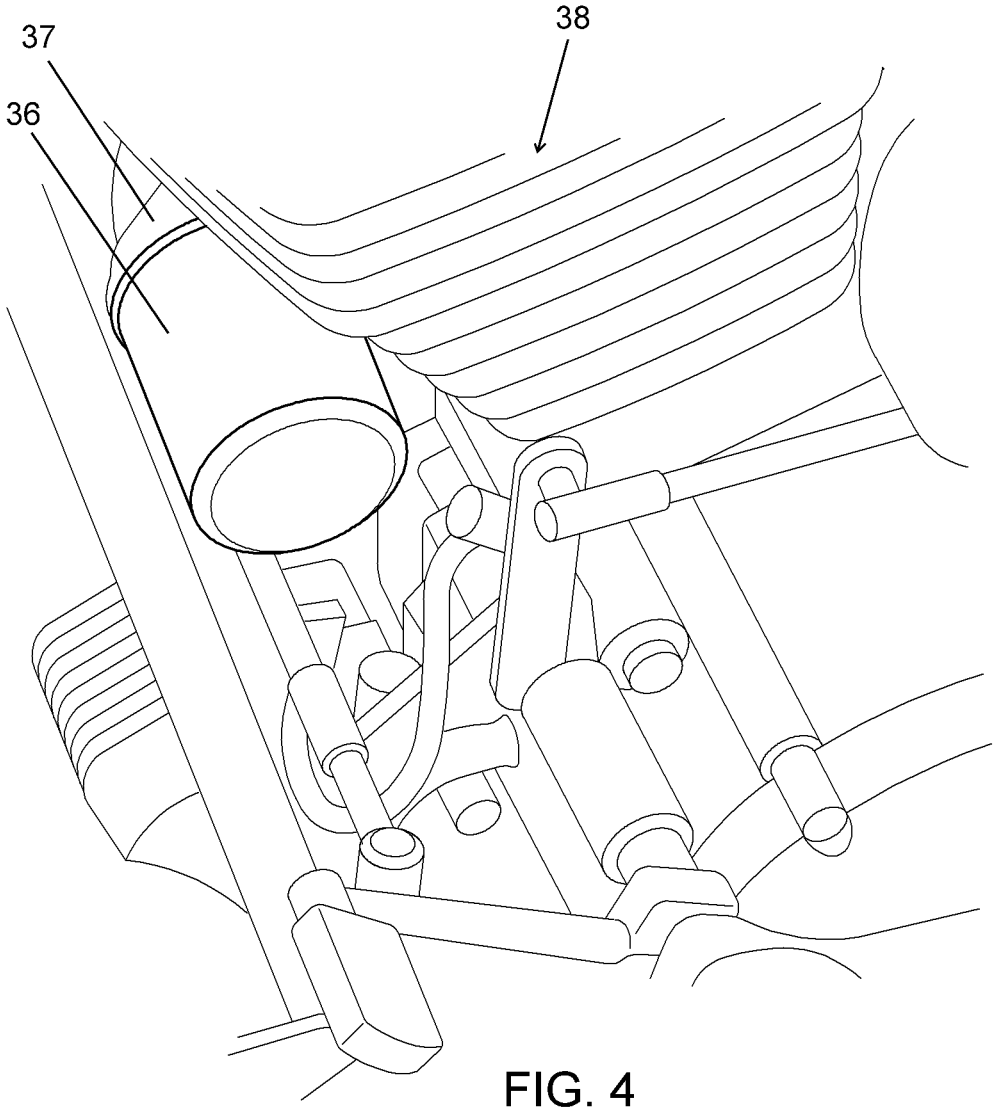
FIGS. 4-9 illustrate the steps of changing an oil filter in accordance with the invention.
Figure 5:
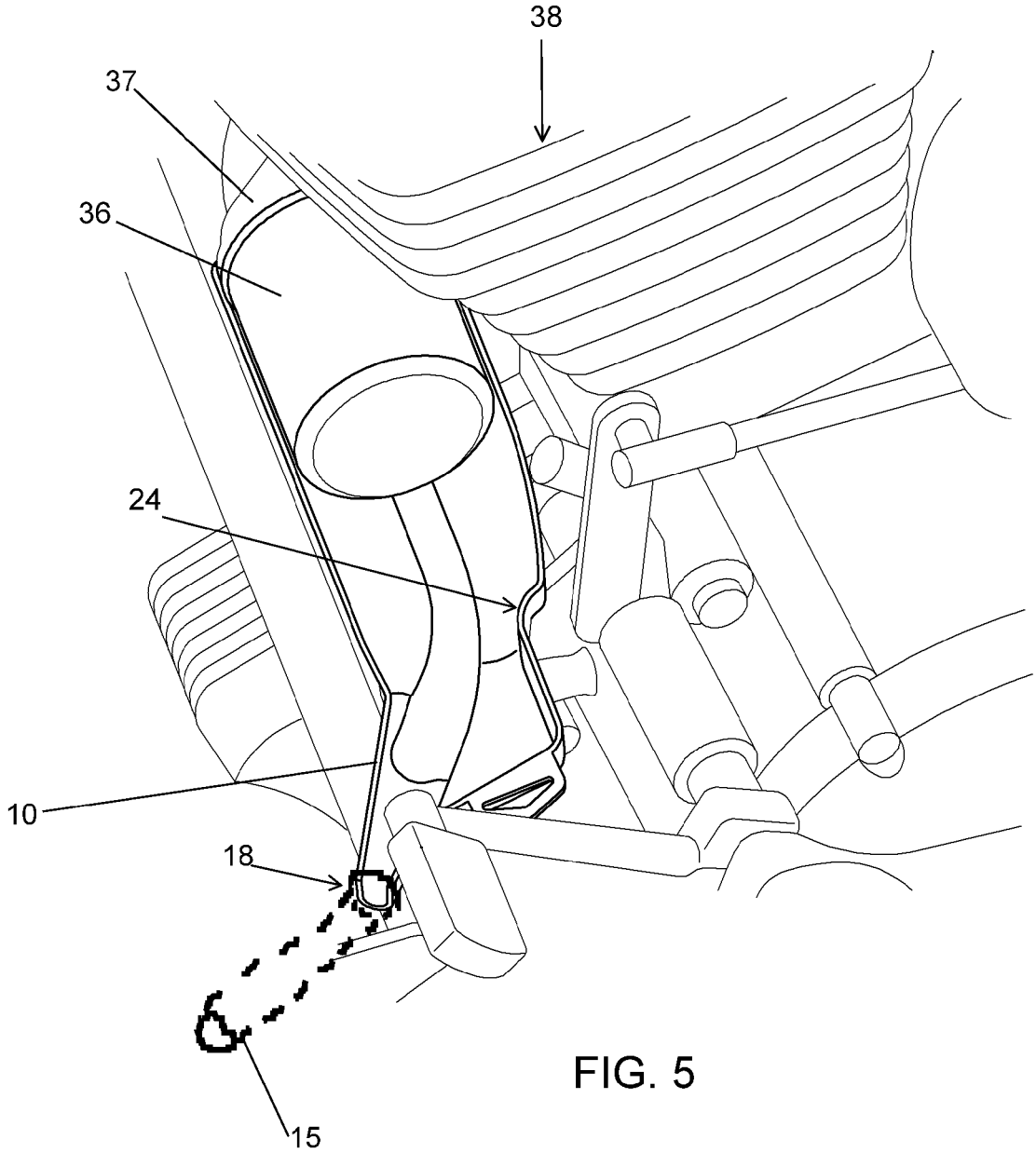

In operation, use of the funnel and the method is accomplished as follows, with reference to FIG. 3, a flow chart of the steps of using the funnel, and FIGS. 4-9, illustrations of the funnel in use during the method. Prior to beginning the filter change, the motorcycle should be leaning on its factor stand, which positions the motorcycle leaning to one side so that oil will appropriately drain through the funnel 10 in operation. FIG. 4 illustrates the configuration of the oil filter 36 in relation to the motorcycle engine 38. The oil filter is typically threaded onto a mount portion 37 of the engine that includes an oil filter seal surface against which an oil filter gasket presses, to provide an oil tight seal. At step 34, the funnel 10 is positioned below the oil filter, as illustrated in FIG. 5. The curved and stepped configuration of the funnel enables the funnel to fit in the space and around the shift pedals, linkages and other motorcycle components of a number of models of motorcycles, e.g., Harley Davidson motorcycles, including Touring, Dyna, Softtail, Sportster and forward control models.

Figure 6:
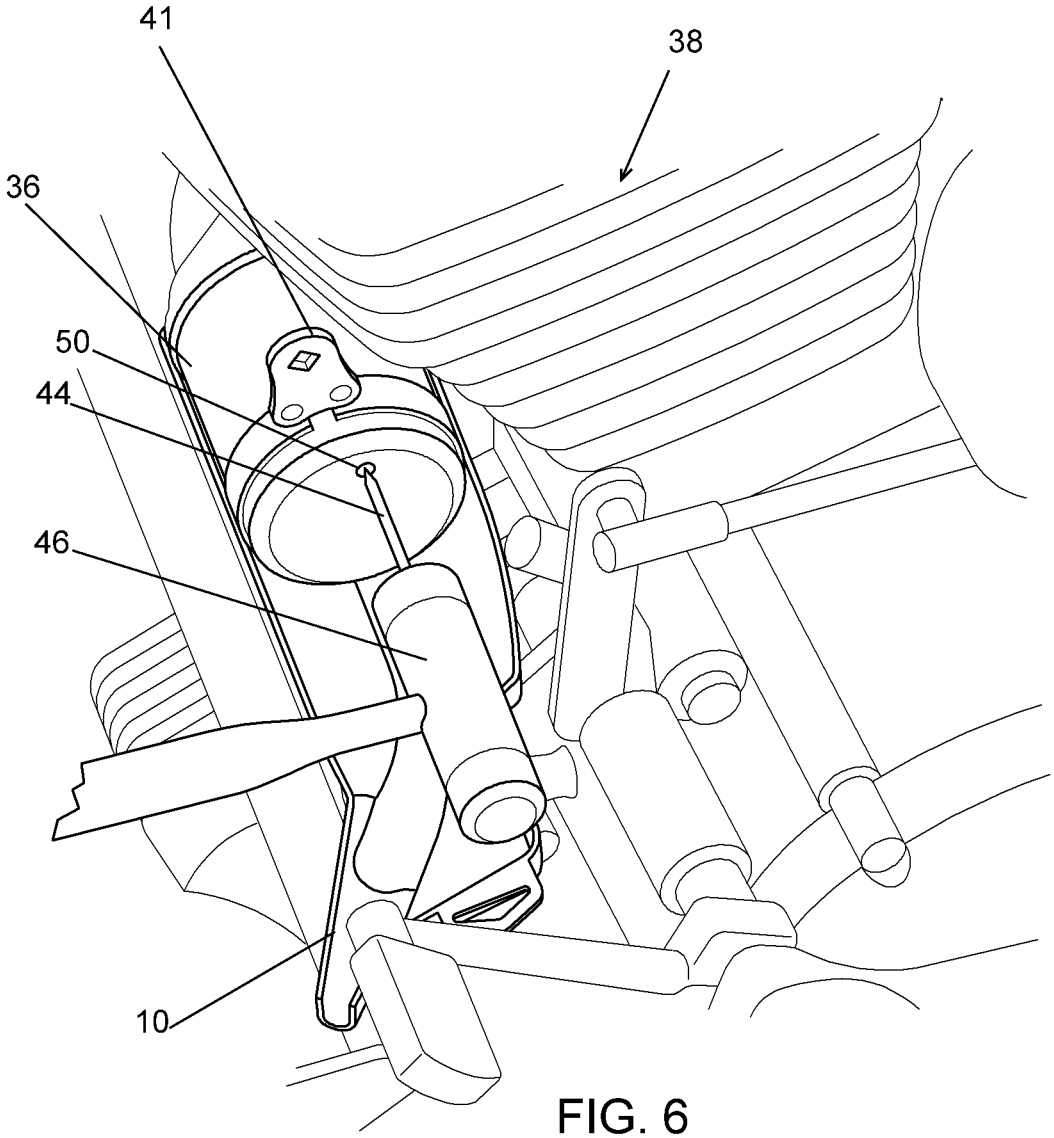

Next, step 40 involves optionally attaching a drain tube 15 to the spout 18, to enable the oil to be carried further away from the immediate location. Referring to FIG. 6, an oil filter removal wrench 41 is mounted to the oil filter, and a hole 50 is formed in the front face of the oil filter, at the top thereof (step 42, FIG. 6), which may suitably be accomplished by positioning the point of a nail 44 at the front face of the oil filter, and tapping the head of the nail with a hammer 46, thus forming a hole in the oil filter. Since the hole is at the top of the filter, little or no oil will drain at this point.

Figure 7:
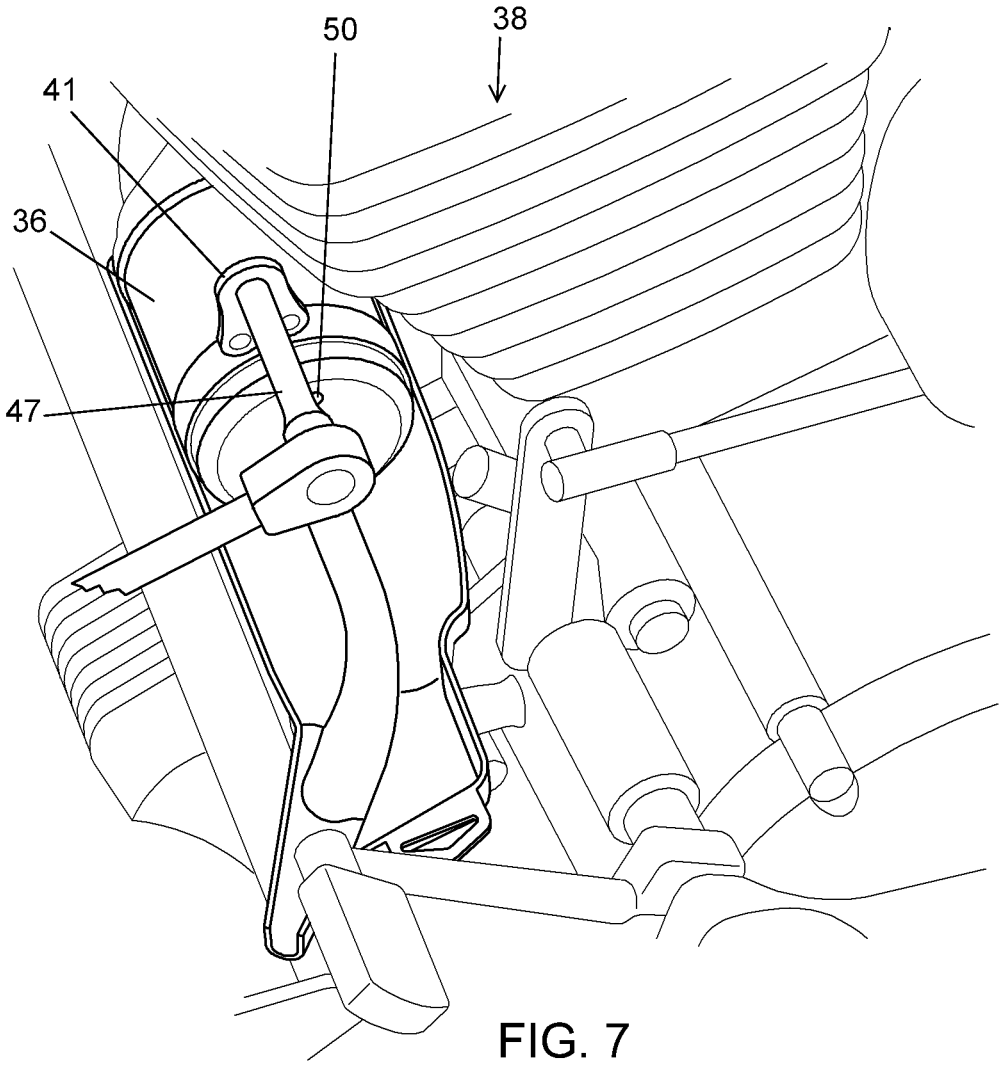
Figure 8:
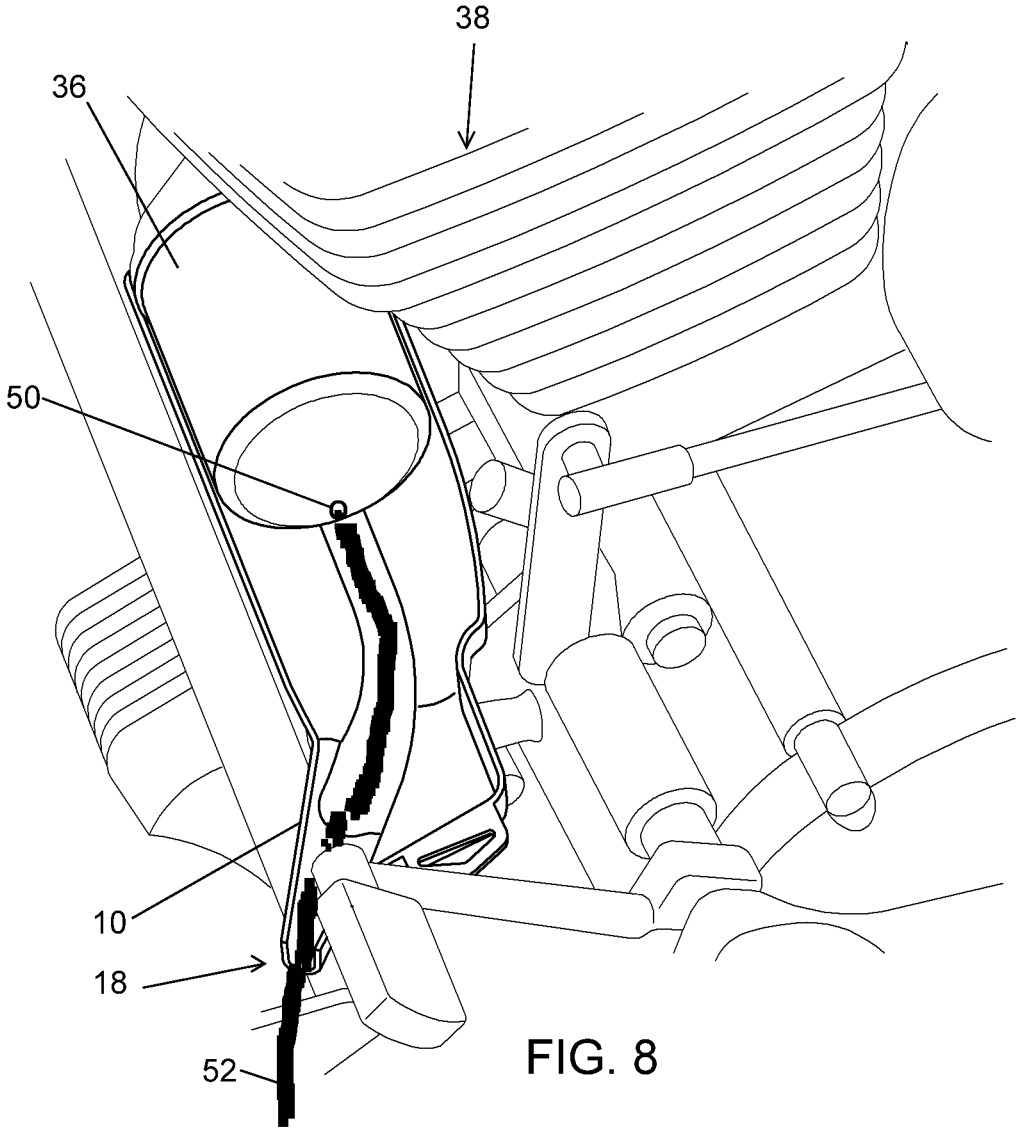
Figure 9:
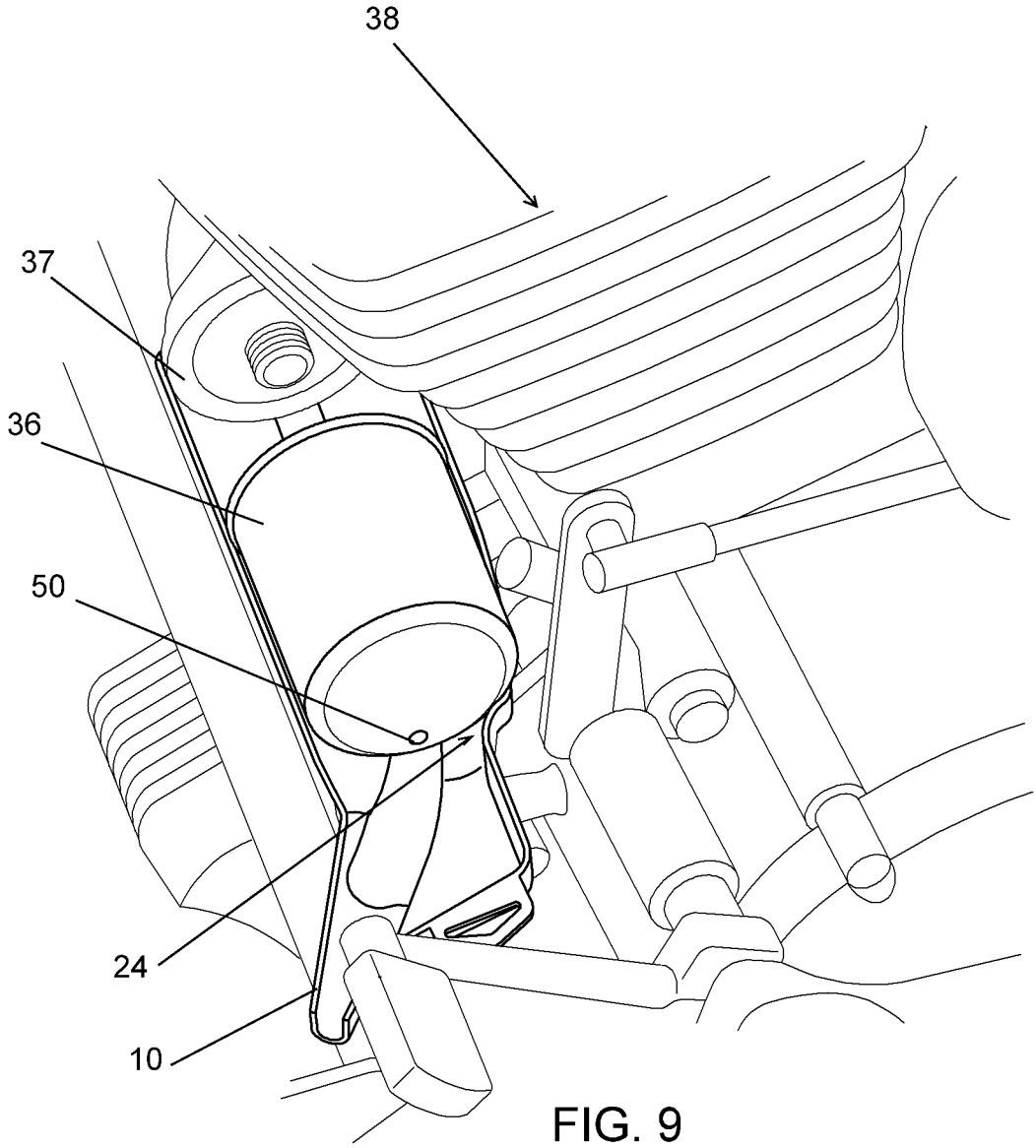
Figure 10:
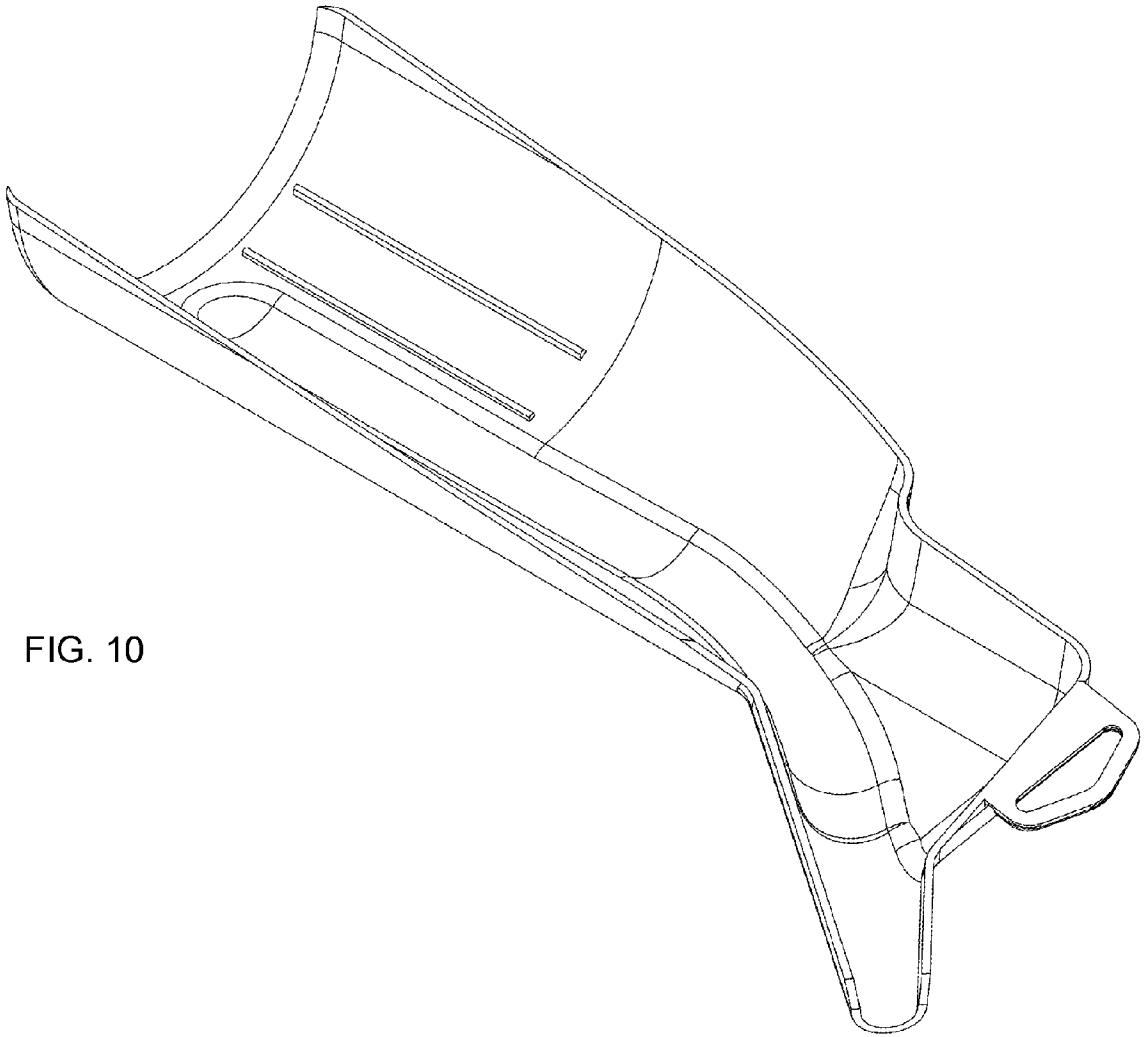
FIG. 10 is a perspective view of the oil filter change funnel illustrating the shape and configuration.
Figure 11:
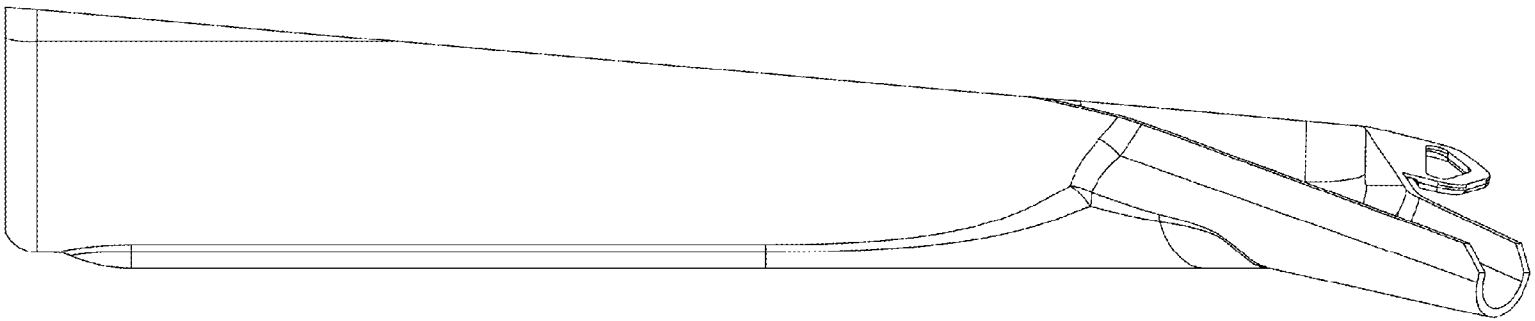
FIG. 11 is a left side view of the funnel of FIG. 10.
Figure 12:
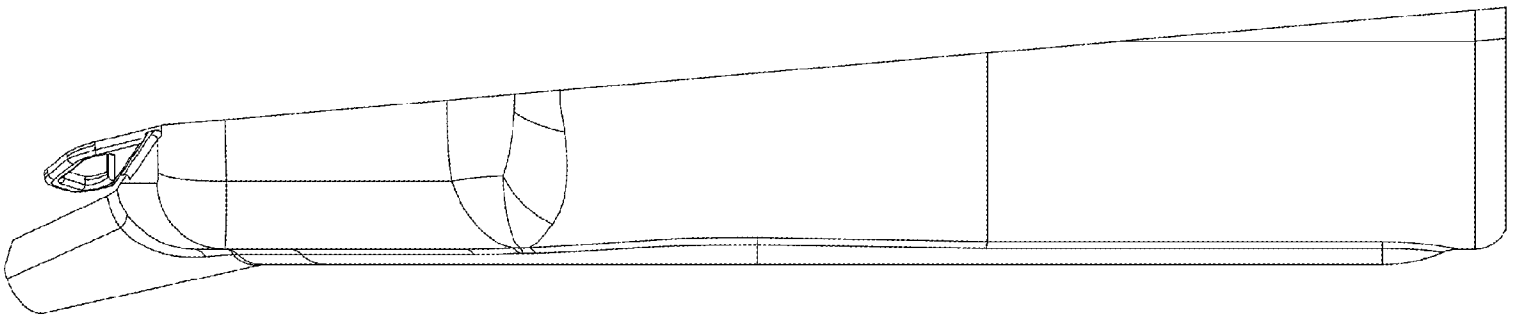
FIG. 12 is a right side view of the funnel of FIG. 10.
Figure 13:
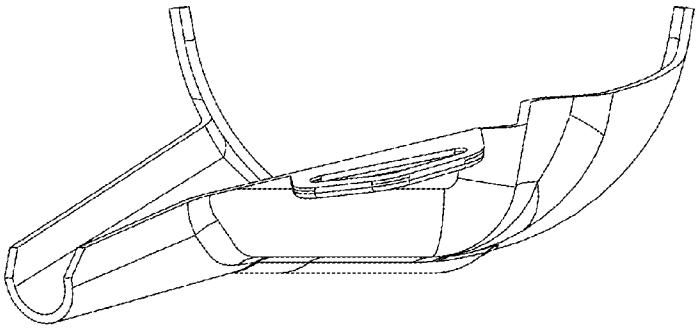
FIG. 13 is a rear end view of the funnel of FIG. 10.
Figure 14:
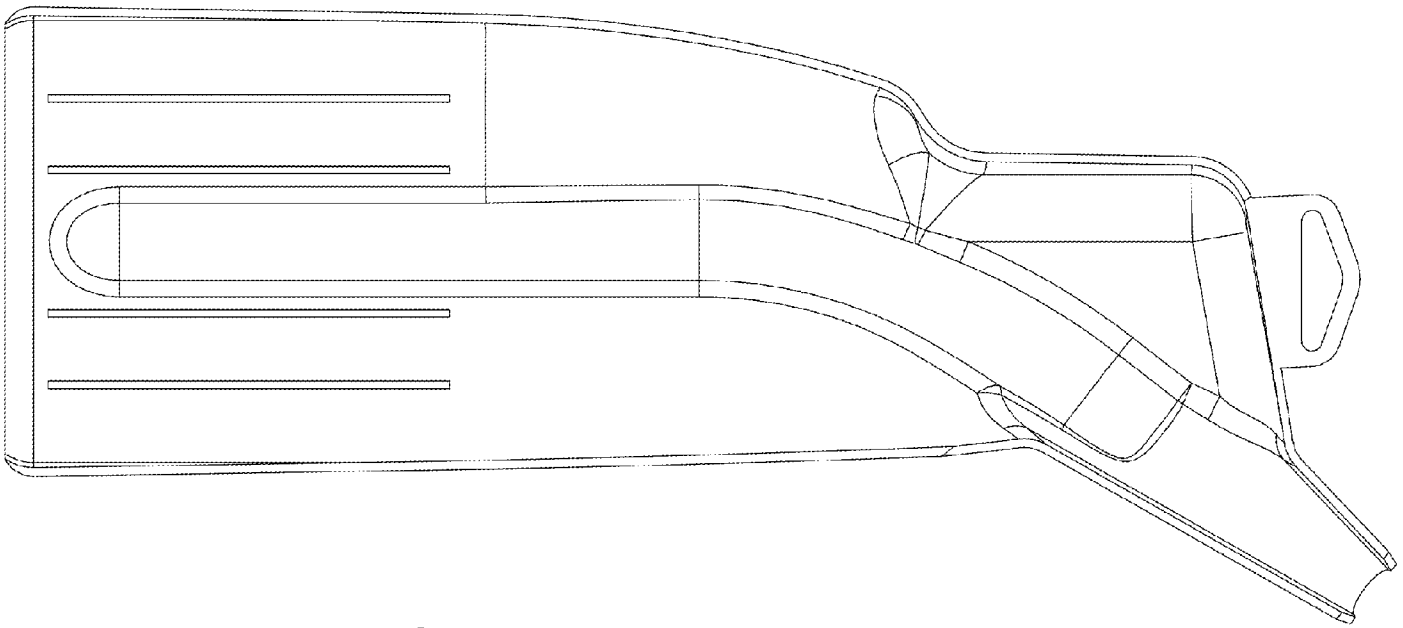
FIG. 14 is a top view of the funnel of FIG. 10.
Figure 15:
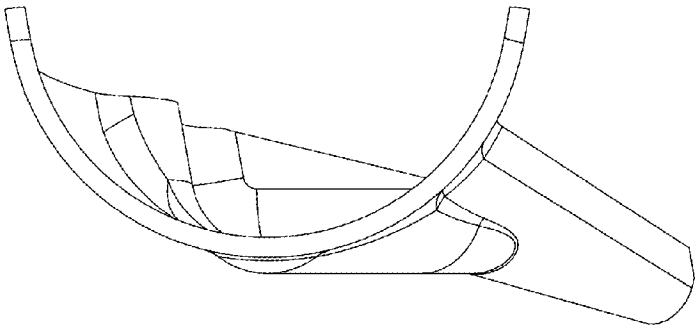
FIG. 15 is a front end view of the funnel of FIG. 10.
Figure 16:
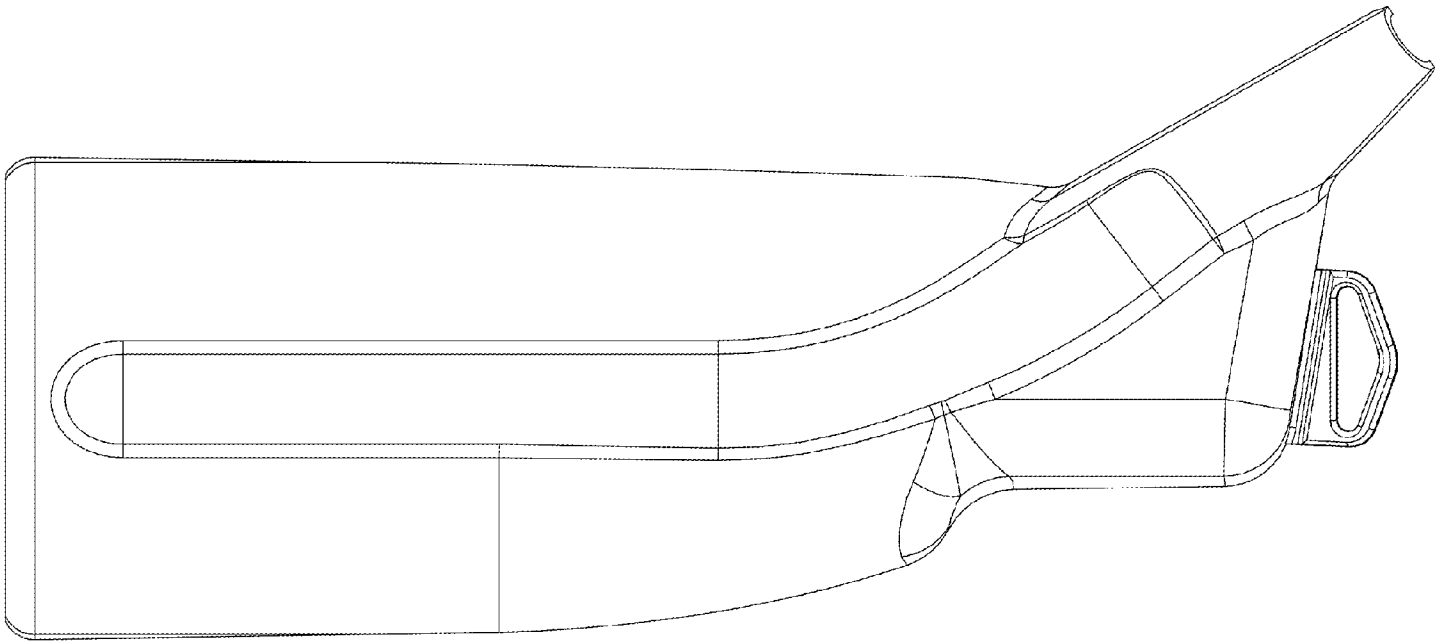
FIG. 16 is a bottom view of the funnel of FIG. 10.

Now, with use of the oil filter wrench 41 (or other suitable method), the oil filter is spun around 180 degrees (for example, by use of socket wrench handle and extension 47) so that the just-formed hole 50 is now positioned at the bottom (step 48), as shown in FIG. 7 and FIG. 8. Alternatively, the hole may initially be made at the bottom of the filter, to allow skipping this step. Oil 52 may begin to drain more at this point, conveyed toward spout 18 (and optional hose 15) by drain channel 16. Removing the motorcycle's oil drain plug and dipstick (step 54) will now allow the oil to drain from the oil filter, as visible in FIG. 8. Since the motorcycle is leaning on its stand, the oil drains well through the hole and out and away via the filter funnel 10. Once the filter is essentially drained, in step 56, the filter is spun the rest of the way off (either by hand or by use of the filter wrench), and the filter is held in the funnel 10, captured by the shape of the step portion 24 (FIG. 9). The shape of step portion 24 defines a stop member, providing a stop against which the oil filter will rest, to define a limit of movement of the oil filter along an inner surface of the funnel as the filter is removed. Since the oil has been substantially drained from the filter, there is no large flow of oil as would happen in accordance with the prior art. Longitudinal ribs 14 assist in allowing the filter to slide longitudinally in the funnel, by minimizing the surface area of contact between the funnel and the oil filter face. At step 58, the filter and funnel may be removed together, leaving the motorcycle ready to receive a new oil filter in replacement of the removed filter.

FIGS. 10-16 illustrate the design of a particular configuration of the filter funnel, comprising a perspective, left side, right side, rear end, top, front end and bottom view, respectively, of the funnel.

An alternative method of using the filter funnel 10 is to apply hand pressure to the filter funnel 10 while twisting the oil filter off, relying on the seal between the end 12 of the filter funnel 10 and the engine to direct the oil flow as the oil filter seal is broken. This allows for the oil filter to be spun off quickly, but the user should ensure that the filter funnel is tightly held to the engine so that oil will not leak past.

Accordingly, the filter funnel 10 provides a unique shape itself fits under the oil filter of many different motorcycles, in a particular embodiment, Harley Davidson motorcycle models, while providing clearance around sensors, wiring, shifting linkages and other obstructions. Oil filter changes may be accomplished without spillage of oil onto the engine.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A funnel for use in oil filter change operations, comprising:

a filter receiving portion having a shape for placement adjacent a filter for capturing oil draining from the filter, said filter receiving portion having left and right upper edges along a region where said filter is received; and at least one contact surface area reduction member defined on an interior face of the filter receiving portion at a position away from the left or right upper edges, for reducing surface area of contact between an oil filter face and a surface of the funnel, to assist in allowing the filter to slide longitudinally in the funnel, by minimizing the surface area of contact between the surface of the funnel and the oil filter face.

2. The funnel according to claim 1, further comprising:

a sealing surface for providing a temporary seal against an engine surface to assist in directing oil into the funnel.

3. The funnel according to claim 2, wherein said sealing surface comprises a substantially hemispherical region at an end of the funnel.

4. The funnel according to claim 1, further comprising:

a drain channel formed as a depression along a longitudinal portion of an interior face of the funnel for directing draining oil away.

5. The funnel according to claim 1, wherein said contact surface area reduction member comprises a longitudinal rib extending along a portion of an inner face of the funnel.

6. The funnel according to claim 4, further comprising:

a spout portion defined at an end of the drain channel for discharging oil from the drain channel.

7. The funnel according to claim 1, wherein said funnel is a motorcycle oil filter change funnel.

8. The funnel according to claim 7, wherein said motorcycle oil filter change funnel is adapted for use for changing oil on a HARLEY DAVIDSON brand motorcycle.

9. A method of changing an oil filter in a motorcycle, comprising the steps of:

positioning, at a location of the oil filter, a funnel member having at least one at least one contact surface area reduction member, for reducing surface area of contact between an oil filter face and a surface of the funnel member, to assist in allowing the filter to slide longitudinally in the funnel member, by minimizing the surface area of contact between the surface of the funnel member and the oil filter face, said funnel member having an oil filter receiving portion having a shape for placement adjacent a filter for capturing oil draining from the filter, said funnel member having a drain channel formed as a depression along a longitudinal portion of an interior face of the funnel for directing draining oil away; and forming an opening in the oil filter near a peripheral edge of a face of the filter to allow oil to drain therefrom into the funnel.

10. The method according to claim 9, further comprising:

said forming an opening step comprising piercing the oil filter to create a hole therein.

11. The method according to claim 9, further comprising the step of moving the oil filter to position the opening formed therein so as to be adjacent the funnel member.

12. The method according to claim 9, further comprising pressing a portion of said funnel member against a surface of the motorcycle to form a temporary seal against oil drainage at said portion.

13. The method according to claim 9, further comprising removing a dipstick and oil drain plug after said positioning and forming steps.

14. The method according to claim 9, further comprising, after oil has drained from said filter a desired amount, removing the filter from the motorcycle.

15. The method according to claim 9, further comprising directing oil away from said funnel through a drain tube.

16. The funnel according to claim 4 wherein said drain channel begins slightly inwardly of a filter end of the filter receiving portion.

17. The funnel according to claim 4 wherein said drain channel extends substantially a length of the funnel.

18. The method according to claim 9 wherein said drain channel begins slightly inwardly of a filter end of the oil filter receiving portion.

19. The method according to claim 9 wherein said drain channel extends substantially a length of the funnel member.

20. The funnel according to claim 1, wherein said contact surface area reduction member comprises a raised portion on the surface of the funnel.

21. A motorcycle oil filter change funnel for use with motorcycles, comprising:

a filter receiving portion having a hemispherical shape for placement adjacent a filter for capturing oil draining from the filter;

a sealing edge adapted for engagement with a filter seal surface of the motorcycle for providing a temporary seal against oil leakage along the sealing edge;

plural rib members on an inner face of said funnel for minimizing surface area of contact between the inner face and the filter, to assist in allowing the filter to slide longitudinally in the filter receiving portion, by minimizing the surface area of contact between the surface of the filter receiving portion and the oil filter face; and a drain channel formed as a depression along a longitudinal portion of an interior face of the filter receiving portion for conveying away oil draining from the filter.

22. The motorcycle oil filter change funnel according to claim 21, further comprising a spout member at an end of the funnel opposite the sealing edge, for directing oil away from the funnel.

23. The motorcycle oil filter change funnel according to claim 21, further comprising a stop member for providing a stop against which the filter rests, to define a limit of longitudinal movement of the filter along an inner surface of the funnel.

24. The motorcycle oil change funnel according to claim 21 wherein said drain channel begins slightly inwardly of the sealing edge.

25. The motorcycle oil change funnel according to claim 21 wherein said drain channel extends substantially a length of the funnel.

26. The funnel according to claim 21, wherein said rib portions comprise raised portions on the inner face of the funnel.

* * * * *